US007854689B2

(12) United States Patent
Blaylock

(10) Patent No.: US 7,854,689 B2
(45) Date of Patent: Dec. 21, 2010

(54) ICE SKATING TRAINING DEVICE

(75) Inventor: Andrew Blaylock, Bloomington, MN (US)

(73) Assignee: Walter James Blaylock, Bloomington, MN (US)

( * ) Notice: Subject to any disclaimer, the term of this patent is extended or adjusted under 35 U.S.C. 154(b) by 642 days.

(21) Appl. No.: 11/516,354

(22) Filed: Sep. 5, 2006

(65) Prior Publication Data

US 2007/0054781 A1 Mar. 8, 2007

Related U.S. Application Data

(60) Provisional application No. 60/714,669, filed on Sep. 6, 2005.

(51) Int. Cl.
*A63B 71/00* (2006.01)
*A63B 69/18* (2006.01)
*A63C 19/10* (2006.01)

(52) U.S. Cl. ..... 482/51; 434/253; 472/90

(58) Field of Classification Search ..... 482/66–69, 482/54, 70–71, 51; 434/253; 472/90–91
See application file for complete search history.

(56) References Cited

U.S. PATENT DOCUMENTS

| | | | | |
|---|---|---|---|---|
| 3,627,109 | A * | 12/1971 | Cabak | 198/840 |
| 5,232,423 | A * | 8/1993 | Hajduczek | 482/68 |
| 5,391,131 | A * | 2/1995 | Gordon | 482/71 |
| 6,350,174 | B1 * | 2/2002 | Halford et al. | 446/444 |
| 6,609,607 | B2 * | 8/2003 | Woltjer et al. | 198/457.03 |
| 6,715,602 | B1 * | 4/2004 | Gartland | 198/810.02 |
| 2005/0263376 | A1 * | 12/2005 | Cotter et al. | 198/831 |

FOREIGN PATENT DOCUMENTS

| | | | |
|---|---|---|---|
| GB | 2335638 | A * | 9/1999 |
| JP | 2007297155 | A * | 11/2007 |

* cited by examiner

*Primary Examiner*—Fenn C Mathew
(74) *Attorney, Agent, or Firm*—N Paul Friederichs

(57) ABSTRACT

An ice skating training device including an arcuate conveyor belt, the belt having a skateable surface; and a plurality of conical rollers supporting said arcuate conveyor belt, at least one of said frusticonical rollers being driven by a motor, ends of said rollers being mounted so that one end is vertically adjustable relative to the opposite end depending on the speed that the ice skater is going.

15 Claims, 2 Drawing Sheets

ICE SKATING TRAINING DEVICE

THE FIELD OF THE PRESENT INVENTION

The present invention relates to training devices and more particularly to a training device for training device for training ice skaters. This application has common inventorship with application Ser. No. 10/854,440, filed May 26, 2004, which disclosure is incorporated herein by reference and further claims priority from application 60/714,669 filed Sep. 6, 2005.

BACKGROUND OF THE PRESENT INVENTION

The crossover step in ice skating is perhaps the most difficult maneuver to learn and may well be the most exhausting step to learn as well. The crossover step is used in turning and essentially involves the skater taking the outside foot, stepping over the inside foot, taking the original inside foot and repositioning it on the inside. Through repeating the step, the skater turns, while in motion. Generally, the cross-over step involves leaning into the turn. Many exercise devices have been developed, including those for ice skating. A review of the prior art in the field shows a great need for improved technology for practicing the most difficult technique in ice skating.

U.S. Pat. No. 6,090,015 (Meyers) discloses a training aid for learning the cross-over step. Generally, the device is positioned on a skating surface at a fixed point. The skater grasps a bar that is pivotally mounted to a center post and skates in a circle. This invention does not simulate the leaning, gravitational forces and needs to be mounted to a skating surface.

U.S. Pat. No. 5,393,282 (Maclean) discloses an exercise device that sort of mimics the steps a skater may use to skate in a straight line. This reference teaches a surface on which a sliding motion may be encountered similar to skating. This reference does not teach the cross-over step or simulation of the forces encountered in executing the cross-over step.

What is needed is a device that teaches the cross-over step. Desirably, the device should simulate the forces encountered during actual execution of the cross-over step on a skating rink, the speed should be adjustable and the device should be easy to store and to set up for use.

SUMMARY OF THE PRESENT INVENTION

The present invention is an ice skating training device. The present invention provides a continuous skateable arcuate surface or planar upper surface. The skateable surface is provided by a continuous frustaconical belt supported on a structure. The belt is approximately oval in cross section. The belt is mounted on a frustaconically shaped powered structure (FIG. 3). In other words, providing an arcuate shaped conveyor belt. The belt is supported adjacent at each end by frusticonically shaped rollers. The two frusticonical rollers are disposed with their smaller ends radially inward. The rollers are circular in cross section. The belt is supported intermediately by the two frusticonically shaped rollers and perhaps by a plurality of conically shaped rollers. Preferably, the belt is supported intermediary to the rollers with guide rails on opposing sides of the belt and the belt being sufficiently stiff to span the distance between the guide rails while supporting a user.

An electric motor may drive one of the frusticonically shaped rollers or may directly drive the belt. Sensing mechanism may be provided to change the driving speed of the electric motor dependent upon the speed of the skater. The faster the skater is going, the faster the motor drives the roller and in turn, the faster the arcuate surface goes, such that the skater remains positioned over the belt's upper surface in substantially the same relative position. The incline may be dependent on the speed at which the belt is turning or may be specified before each skating interval. The faster the belt is going, the greater the incline in the case where incline is dependent on speed. There may be a speed sensor trained on the skater.

The belt supporting structure may be as shown in U.S. Pat. No. 6,105,755, which such description incorporated herein by reference.

Advantageously, the present invention has a frustoconically shaped belt upon which a user can skate.

Also as an advantage, the belt include frustoconically shaped rollers disposed at two opposing points on the belt such that the longer edge moves faster than the shorter edge.

As yet a further advantage, the ice skate training device is easily storable being perhaps half the size of a disc shaped training device.

These and other advantages will become clear from reading the description with reference to the associated drawings.

IN THE DRAWINGS

DETAILED DESCRIPTION OF THE PRESENT INVENTION

Figure 1:
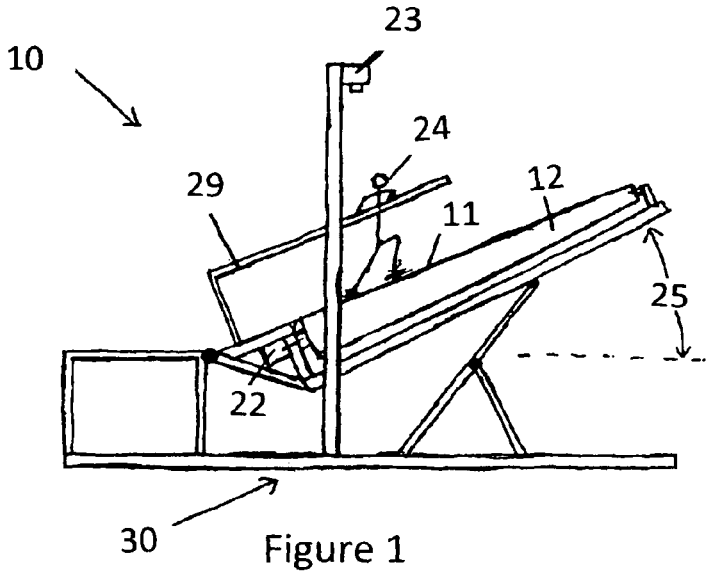
FIG. 1 is a side view showing present invention with a skater.
Figure 2:
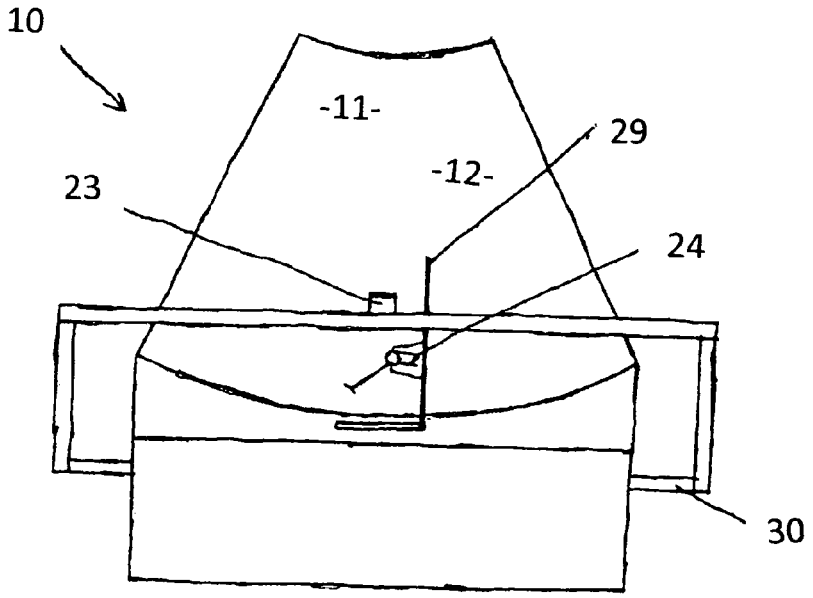
FIG. 2 is a top view.
Figure 4:
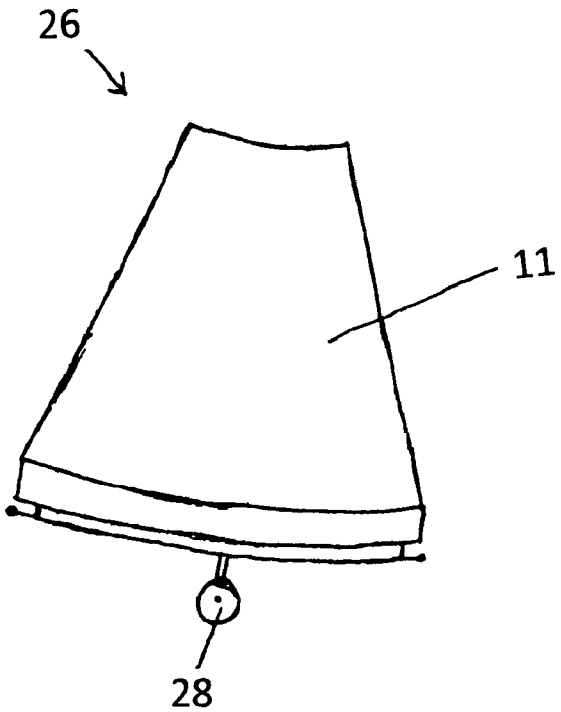
FIG. 4 is a prospective view of a plank showing the guide rail wheel.
Figure 3:
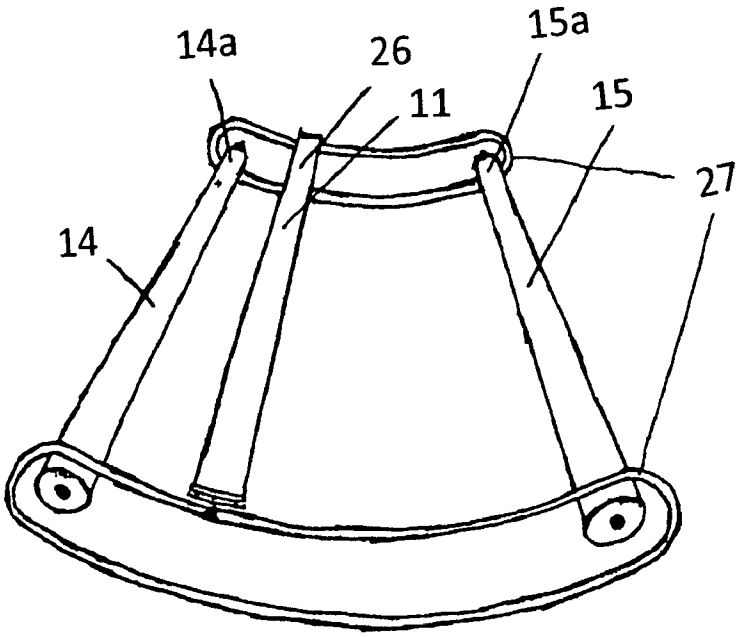
FIG. 3 is prospective view of the guide rails, frusticonicals rollers and a plank.

The present invention 10 is an ice skating training device. (FIG. 1) The present invention 10 provides a continuous skateable arcuate surface 11. The skateable surface 11 may provided by a continuous frusticonical belt 12. The belt 12 is approximately oval in cross section. (FIGS. 2 and 3) The belt 12 mounted on a frusticonically shaped structure 12. (FIG. 3) The belt 12 is desirably supported adjacent at each end by a frusticonically shaped roller 14 and 15. The rollers 14,15 are circular in cross section. (FIG. 3) The frusticonically shaped rollers 14 and 15 are disposed with their smaller ends 14*a*, 15*a* directed radially inwardly. The device 10 may be supported by a frame 30 and be provided with an adjustable hold bar 32, which gives the skater 24 a place to grasp and steady themself, during the learning process.

The belt 12 can be supported intermediately of the two frusticonically shaped rollers 14,15 by a plurality of frusticonically shaped rollers or a minimal friction support table. Preferably, the belt 12 is supported intermediary to the rollers 14,15 by outer guide rails 27. The frusticonically shaped rollers 14,15 are driven by an electric motor 22. Sensing mechanism 23 may be provided to change the driving speed of the electric motor 22 dependent upon the speed of the skater 24. Alternatively, the electric motor 22 may operate at a preset drive speed. The faster the skater 24 is going, the faster the motor 22 drives the roller 14 and in turn the faster the arcuate surface 11 goes, such that the skater 24 remains positioned over the belt upper surface 11 in substantially the same relative position. The incline 25 may be dependent on the speed at which the belt 12 is turning. In this case, the faster the belt 12 is going, the greater the incline. There may be a speed sensor 23 trained on the skater 24. The lean angle θ may be approximately determined from the formula $\theta=\tan^{-1}(gR/V^2)$, where g is the acceleration of gravity, R is the turn radius, and V is the desired velocity.

The belt supporting structure 13 may be as shown in U.S. Pat. No. 6,105,755, which description is incorporated by reference. The belt 12 itself may be a plank 26 structure built with articulation to navigate the frustaconical rollers 14,15. Each plank may have a guide rail wheels 28 that engages the guide rails 27. The articulation of the planks 26 articulation is known to those of ordinary skill in the art. The surface of the belt 12 may be an artificial ice type surface or a high friction surface for in-line skating.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as 'comprises' or 'comprising', will be understood to imply the inclusion of a stated integer or step or group of integers or steps but not to the exclusion of any other integer or step or group of integers or steps.

Moreover, the word "substantially' when used with an adjective or adverb is intended to enhance the scope of the particular characteristic; e.g., substantially planar is intended to mean planar, nearly planar and/or exhibiting characteristics associated with a planar element.

What is claimed is:

1. An ice skating training device comprising:

a skateable surface;

a plurality of rollers supporting said skateable surface;

a motor driving said skateable surface;

sensing means for determining the speed of a skater on the skateable surface and for adjusting the speed of the motor such that the skateable surface matches the speed of a skater;

adjustment means for vertically adjusting said skateable surface thereby forming an incline and the incline being dependant on the speed of the skateable surface and being generally equivalent to the lateral lean angle encountered when turning on ice

2. The ice skating device of claim 1, wherein said skateable surface is supported by guide rails.

3. The ice skating device of claim 1 wherein the lateral lean angle is generally equal to $\tan^{-1}(gR/V^2)$ where g is the acceleration of gravity, R is the turn radius and V is the velocity of a skater relative to the skateable surface.

4. The ice skating device of claim 1 wherein the skateable surface is an arcuate belt, which belt is a plank structure.

5. An ice skating training device comprising:

an arcuate conveyor belt, the belt having a skateable surface;

a plurality of rollers supporting said arcuate conveyor belt;

a motor operably joined to at least one of said rollers;

means for changing the speed of the motor such that a skater remains in substantially the same relative position regardless of adjustments of the speed of the skater relative to the belt; and means for adjusting ends of said rollers so that one end is vertically adjustable relative to the opposite end depending on the speed of an ice skater relative to the belt, the means for adjusting further being a means for maintaining a lean angle of a skater relative to the belt, the lean angle being generally equal to $\tan^{-1}(gR/V^2)$ where g is the acceleration of gravity, R is the turn radius and V is the velocity of the skater relative to the belt.

6. The ice skating device of claim 5, wherein said belt is supported by guide rails.

7. The ice skating device of claim 5 further comprising:

a sensing mechanism, the sensing mechanism aiding in adjusting a speed of the arcuate belt to a speed of a skater.

8. The ice skating device of claim 5 wherein the arcuate belt is a plank structure.

9. An ice skating training device comprising:

an arcuate conveyor belt;

a plurality of rollers supporting said arcuate conveyor belt;

a motor drivably joined to the arcuate belt being;

ends of said rollers being mounted so that one end is vertically adjustable relative to the opposite end depending on a velocity of an ice skater relative to the belt, the arcuate belt having a lean angle, the lean angle being generally equal to $\tan^{-1}(gR/V^2)$ where g is the acceleration of gravity, R is the turn radius and V is a velocity of an ice skater relative to the belt, the lean angle being adjustable in correlation with a velocity of a skater relative to the belt.

10. The ice skating device of claim 9, wherein said belt is supported by guide rails.

11. The ice skating device of claim 9 further comprising:

a sensing mechanism, the sensing mechanism aiding in adjusting a speed of the arcuate belt to a speed of a skater and aiding in adjusting the lean angle.

12. The ice skating device of claim 9 wherein the arcuate belt is a plank structure.

13. The ice skating device of claim 9 wherein the arcuate belt has a skateable surface.

14. The ice skating device of claim 9 wherein at least one of the rollers is driven by a motor and the roller drives the arcuate belt.

15. The ice skating device of claim 9 further comprising a hold bar positioned to be grasped by a user, while a user is on the belt.

* * * * *